US005105589A

United States Patent [19]

Rodriguez

[11] Patent Number: 5,105,589

[45] Date of Patent: Apr. 21, 1992

[54] MODULAR TETRAHEDRAL STRUCTURE FOR HOUSES

[76] Inventor: Osvaldo N. Rodriguez, Av. Belgrano 2124 4ºP. "A", Buenos Aires, Argentina

[21] Appl. No.: 604,391

[22] Filed: Oct. 29, 1990

Related U.S. Application Data

[63] Continuation of Ser. No. 260,674, Oct. 21, 1988, abandoned.

[30] Foreign Application Priority Data

Oct. 26, 1987 [AR] Argentina ..... 309.121

[51] Int. Cl.[5] ..... E04H 1/00

[52] U.S. Cl. ..... 52/79.1; 52/648; 52/DIG. 10

[58] Field of Search ..... 52/DIG. 10, 79.1, 646, 52/648

[56] References Cited

U.S. PATENT DOCUMENTS

| | | | |
|---|---|---|---|
| 2,178,667 | 11/1939 | Littlefield | 52/DIG. 10 |
| 3,710,528 | 1/1973 | Riedberger | 52/DIG. 10 |
| 4,722,162 | 2/1988 | Wilensky | 52/DIG. 10 |
| 4,869,041 | 9/1989 | Chu | 52/648 |

FOREIGN PATENT DOCUMENTS

| | | | |
|---|---|---|---|
| 2578281 | 9/1986 | France | 52/DIG. 10 |
| 699153 | 11/1979 | U.S.S.R. | 52/DIG. 10 |

*Primary Examiner*—Henry E. Raduazo
*Attorney, Agent, or Firm*—Anthony A. O'Brien

[57] ABSTRACT

A modular building structure is disclosed as including a plurality of tetrahedral cells selectively arranged to form multiple dwellings wherein each cell has six bars two of which are horizontally spaced transverse to each other and with the remaining four bars disposed diagonally to the two horizontally spaced bars.

2 Claims, 1 Drawing Sheet

MODULAR TETRAHEDRAL STRUCTURE FOR HOUSES

This application is a continuation of Ser. No. 260,674 filled Oct. 21, 1988 and now abandoned.

TECHNICAL DESCRIPTION

The present invention relates to a modular tetrahedral structure for houses.

More specificly, it relates to a modular structure comprising tubular bars forming a tetrahedral frame used in erecting highly antiseismic economical houses.

The conventional structures for building economical homes consisting in beams and other elements of steel, timber, reinforced concrete and the like, are well known.

The present invention has the unique feature of being a prefabricated module for building structures either by the combination of a universal unit used in assembling houses and reduced rooms, garages, etc., or by the combination of a joined plurality of such modules facilitating the construction of bigger houses responding to various designs and provided with superposed floors.

The combined tetrahedral modules according to building plan and other requisites result in architectural forms having an effective and competitive role in any design.

In addition, the present module, plain or combined, is endowed with the special condition of being antiseismic. because every wall of a quadriform house is crossed by a diagonal tubular bar which avoids having to resist any type of earth tremor; the total collapse walls as being useless is avoided by the diagonal allowing at most the shelling and/or partial collpase of the walls.

The tubular structure of this invention is endowed with a high strength due to the fact that when the roof is used as a terrace or store floor, it is reinforced by another a reinforcing bar-like element arranged parallel to the floor's bar like element; further reinforcement is accomplished by a lattice-like structure mode of small tubes arranged at 45 degrees and separated at least 30 centimeters apart thus fulfilling a structural beam function.

Combinations may be multiple, specially upon deploying creative constructive imagination.

But with the mere aim to make an example it is possible to appreciate how restoring to only two or three modules it is feasible to attain an extraordinary structure for building very interesting houses as can be observed int he graphical part of this technical description.

It so ensues that a stereometric structure appears resorting to bars and welds connecting their ends, all of which configure tetrahedrons the faces of which are always equilateral triangles.

With such triangulation, this spatial geometry grants a maximal stiffness or rigidity and a substantial weight reduction.

By means of this structure it is possible to configure habitable rooms, the conformed cube being taken as a spatial module; it is precisely through its faces or sides that the diagonals pertaining to the tetrahedron edges have to pass.

This tetrahedral modular structure allows to realize assemblies, not only of the extensive but also of the accumulative type; furthermore, the spatial generation being of the open type, the possibility exists for an unlimited number of solutions, from straight prisms to sloped planes, with various intermediate forms.

As for the closures, it is perfectly possible to utilize any kind of known element it being feasible to resort to the means available in the building locality such as timber, stones, etc.

This tetrahedral module is built of steel tubes up to 4.30 meter in their edges; once the tubes conformed, lengths of 3.04 meter result, perfectly adequate for different kinds of usable rooms.

These triaxially triangulated bars result in an elevated structure able to resist horizontal pressures practically of the same magnitude as the vertical loads; this makes them specially recomendable for seismic areas.

Said modules of six equal edges unify the geometry of the element, with the exception of the horizontal top bars which are reinforced with a lattice in order to perform as a structural beam supporting the upper floor.

For example, the tubes utilized as diagonals in designs of up to two levels and a partial third one, have a 90 mm O.D. (outside diameter) and a 4 mm thickness.

As for the horizontal bars performing as floor beams, they are configurated by two parallel running tubes, separated 30 cm apart and linked with diagonals at 45 degrees, made of tubes 0.25 mm, 2 mm thick, all of them, welded.

This module results to weigh 22 kilog per covered square meter; this means a substantial investment reduction as compared with a conventional trilithic structure to which must be added the pertaining reinforcement for the floor slab of around 4 to 5 Mg per sq.mt, thus totalling 27 kg/sq.mt.

The joints connecting the ends of the bars can be realized by means of auxiliary welded or bolted plates intended for possible future recuperation.

Other and additional aspects, objects and advantages of this invention will become apparent from the reading of the description in its mechanical part and from an exemple of same.

And for attaining more explicative clarity about the nature of this invention, and about the way to carry out same, an example is being described in conjunction with reference numbers and with the help of the accompanying drawings wherein identical reference numbers are used for identical parts.

It is naturally understood that said illustrated.

In the illustrative drawings, equal reference numbers means equal parts, according to recitations in the claims.

Figure 5:
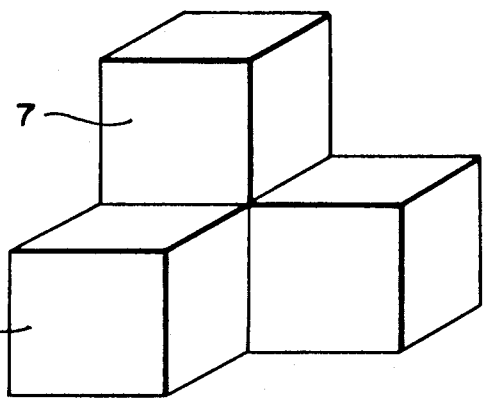
FIG. 5 illustrates how it is possible to accumulate the cubes taking advantage of the mutual linkage of the tetrahedral modules.
Figure 4:
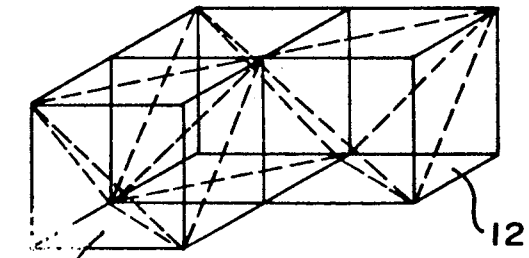
FIG. 4 illustrates how cubes and themselves extensively taking advantage of the modules, all of them mutually linked.
Figure 1:
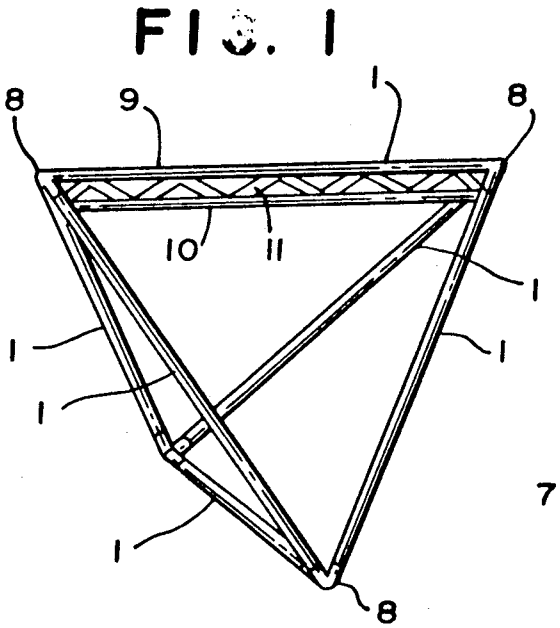
FIG. 1 shows a perspective view of the house seembly module with its special tetrahedral form.
Figure 3:
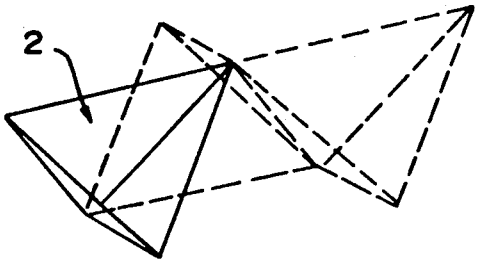
FIG. 3 is another schematic view of how it is possible to combine this module in order to attain a house different from a architectural point of view.
Figure 2:
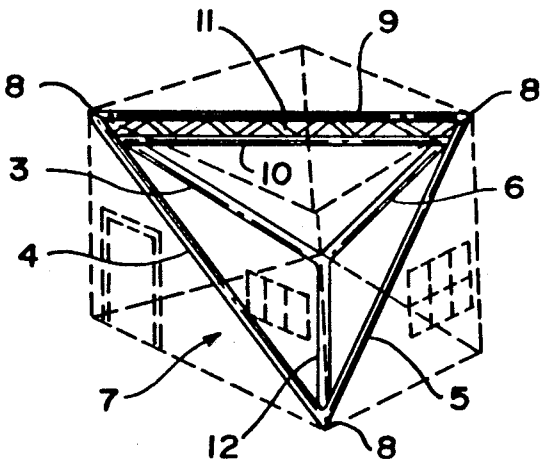
FIG. 2 shows how this module distributes or spreads its bars through walls, floor and ceiling of a room.

In such a way and according to abovementioned, the following description is given of the parts integrating the instant invention which briefly includes an assembly of six straight tubular bars 1 (FIG. 1) arranged in a tetrahedral configuration 2 (FIG. 3). As is shown in FIG. 2, a plurality of bar-like elements 3, 4, 5 and 6 are arranged diagonally with respect to walls 7; defining sides of a module closure.

The unions or joints 8 of the end or vertexes are carried out by weldings, auxiliary plates or boltings.

All the tubular straight bar-like elements 1 and horizontal straight bar-like elements 9 and 10 are tubular in construction; when the top horizontal bar 9 performs as a floor beam, it is reinforced with a second tubular bar 10 arranged parallel thereto and distanced 30 cm apart and is provided with a plurality of small diagonal tubes 11 welded at 45 degrees to the horizontal bars 9 and 10.

This top horizontal bar 9 erases at 90 degrees the lower bar 12 which completes the tetrahedral assembly for erecting houses or rooms usable for any purpose. The tetrahedral modular assembly as shown in FIG. 2 includes six tubular straight bar-like elements 3,4,5,6,9, and 10 which are to one another at their ends as by welds 8 defining a regular tetrahedron configuration. The first element 9 and the second element 12 are horizontal and displaced 90° from each other in the form of a cross. Four additional elements 3, 4, 5, and 6 define diagonal supports conforming to side faces of an imaginary cube. A first pair 3,6 of the additional elements each has a lower end joined together along with one end of the second element 12; one of the first additional elements 3,6 has an upper end joined to one end of the horizontal element 9 and the other of the first additional elements 3,6 has an upper end to an opposite end of the horizontal element 9. A second pair 4,5 of the additional elements have adjacent lower ends joined together with an opposite end of the horizontal element 12; one of the second additional elements 4,5 has an upper end joined to the one end of the horizontal element 9 and the other of the second additional elements 4,5 has an upper end joined to the opposite end of horizontal element 9. The reinforcing element 10 is arranged parallel to and horizontally spaced from the horizontal element 9 with the lattice tubing 11 disposed therebetween.

Whereas the invention has been described and illustrated in present descriptive exhaustive, said description should be considered as illustrative and neither limiting the type of invention nor being taxative; consequently any modification readily executable shall be considered to be integral part of the invention, to which reference is made in the appended claims.

Instant invention having been described as well the way same has to be put into practice, it is stated to claim as exclusive property and rights:

1. In a modular building structure, the combination comprising a plurality of tetrahedral cells arrangable horizontally and vertically in a cumulative manner to form multiple dwellings, each cell including an assembly of six bars, two of said bars (9 and 12) being in horizontally spaced relation to each other and crossing each other at 90°, the remaining four of said bars (3, 4, 5 and 6) being diagonally disposed from said bars (9 and 12), a first pair of said four bars (3 and 4) having first lower ends joined to opposite ends of one of said crossed bars (12) and first upper ends joined together to one end of the other crossed bar (9), a second pair of four bars (5 and 6) having second lower ends joined to opposite ends of said one crossed bar (12) and to the adjacent lower end of each first pair of four bars (3 and 4) and having second upper ends joined together and to the other end of said crossed bar (9), said six bars forming the edges of a tetrahedral cell, said pairs of diagonal bars (3, 4 and 5, 6) corresponding with lateral faces of a virtual cube which defines an habitable space of the dwelling, said crossed bars (9 and 12) of each assembly being in correspondence with diagonal bars of opposite bases of the virtual cube, the bars forming the edges of the tetrahedral cell coinciding with bars of an immediately adjacent assembly to provide selected vertically and horizontally consecutive habitable spaces, at least one of said bars (9) having a moment-load reinforcing means including bar-like element (10) and a lattice-like structure between the bar (9) and the bar-like element (10), and wherein the remainder of said bars are free from reinforcing means.

2. A modular tetrahedral structure as claimed in claim 1 wherein said bars are tubular elements.

* * * * *